US007121684B2

(12) United States Patent
Barozzini et al.

(10) Patent No.: US 7,121,684 B2
(45) Date of Patent: Oct. 17, 2006

(54) GARAGE LIGHT LUMINAIRE WITH CIRCULAR COMPACT FLUORESCENT EMERGENCY LIGHTING OPTICS

(75) Inventors: Claude Barozzini, Austin, TX (US); Robert L. Summerford, Selma, TX (US)

(73) Assignee: Genlyte Thomas Group, LLC, Louisville, KY (US)

( * ) Notice: Subject to any disclaimer, the term of this patent is extended or adjusted under 35 U.S.C. 154(b) by 111 days.

(21) Appl. No.: 10/865,301

(22) Filed: Jun. 10, 2004

(65) Prior Publication Data

US 2005/0276047 A1 Dec. 15, 2005

(51) Int. Cl.
*F21S 7/00* (2006.01)

(52) U.S. Cl. ..... 362/228; 362/260

(58) Field of Classification Search ..... 362/20, 362/216, 228, 247, 252, 304, 157, 260
See application file for complete search history.

(56) References Cited

U.S. PATENT DOCUMENTS

| | | | | |
|---|---|---|---|---|
| 2,209,052 | A | 7/1940 | Corlburg | |
| 2,441,399 | A | 5/1948 | De Reamer et al. | |
| 2,451,580 | A | 10/1948 | Schwinger | |
| 2,454,243 | A * | 11/1948 | Wiedenhoeft | 362/216 |
| 2,494,058 | A | 1/1950 | Ries et al. | |
| 2,538,681 | A * | 1/1951 | Gangbin | 362/216 |
| 3,061,758 | A * | 10/1962 | Cobb | 315/84 |
| 3,220,327 | A | 11/1965 | Hunger | |
| 3,287,551 | A | 11/1966 | Vin Dick | |
| 3,335,268 | A * | 8/1967 | Baldwin | 362/486 |
| 3,930,148 | A | 12/1975 | Gruen | |
| 4,225,905 | A | 9/1980 | Moriyama et al. | |
| 4,399,492 | A | 8/1983 | Kolesar | |
| 4,682,078 | A * | 7/1987 | Pascalide | 315/86 |
| 5,595,438 | A * | 1/1997 | Burd | 362/228 |
| 5,785,413 | A | 7/1998 | Tillinghast et al. | |
| 6,022,125 | A | 2/2000 | Bartasevich et al. | |
| 6,024,461 | A | 2/2000 | Norman | |
| 6,084,358 | A * | 7/2000 | Dolson | 315/226 |
| 6,454,433 | B1 * | 9/2002 | Alessio | 362/157 |
| 6,489,729 | B1 | 12/2002 | Erhardt et al. | |
| 6,572,234 | B1 | 6/2003 | Maier et al. | |
| 2003/0043585 | A1 | 3/2003 | Rohlfing et al. | |

* cited by examiner

*Primary Examiner*—Sandra O'Shea
*Assistant Examiner*—James W Cranson, Jr.
(74) *Attorney, Agent, or Firm*—Steve A. Witters; Middleton Reutlinger

(57) ABSTRACT

The present invention relates to a garage light assembly having a housing with a lamp mounting surface wherein a main high intensity discharge lamp and an auxiliary circular high output fluorescent lamp are mounted. The auxiliary lamp is mounted centrally within the assembly and above the light emitting portion of the high intensity discharge lamp so that the light pattern emitted from the auxiliary lamp is symmetrical and the auxiliary lamp does not shadow the light emitted from the high intensity discharge lamp.

22 Claims, 10 Drawing Sheets

GARAGE LIGHT LUMINAIRE WITH CIRCULAR COMPACT FLUORESCENT EMERGENCY LIGHTING OPTICS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

This invention relates to the lighting arts, and in particular to an electronic auxiliary lighting system for a high intensity discharge lamp. More particularly, the auxiliary lighting system of the present invention uses as a light source a high output compact fluorescent lamp.

2. Description of Related Art

A high-intensity discharge (HID) lamp will extinguish when power to the HID lamp is interrupted. Momentary power interruptions, such as a lightning strike or someone inadvertently hitting the on/off switch, will cause the HID lamp to extinguish. An extinguished HID lamp will not immediately re-ignite upon the restoration of power to the HID lamp because gases within the HID lamp must be cooled before the HID lamp will re-ignite. With the power restored, restarting a hot HID lamp can take several minutes. Even when they are cool, and easy to start, HID lamps still take up to 2 minutes to come to full bright after they are ignited.

The garage building industry puts a great deal of stock in emergency lighting standards. The industry likes to see a certain minimum amount of light along path of egress in their structures during power interruptions. Accordingly, auxiliary lighting control circuitry has been used for automatically lighting an auxiliary light source, such as an incandescent lamp, following a brief power interruption of a HID lamp. It is known in the art to use quartz lamps to meet these emergency lighting requirements. Round and square garage lights having a HID lamp as a primary light source and a quartz auxiliary lamp have been used for many years. The premise is that when the HID lamp, located at the center of the fixture, is not on the quartz lamp, which is typically a smaller cylindrical incandescent lamp mounted to the side of the HID lamp, is lit to provide emergency illumination. However, there are inherent problems with these current practices of providing auxiliary light to garage lighting systems.

The quartz lamps that are typically used as auxiliary lamps are short lived and are very inefficient in converting electric power into lumens. This causes problems with continued reliability, maintenance, and the ability to meet auxiliary lighting needs. A significant problem associated with these current practices is that the quartz lamps are not located at the photometric center of the fixture. This causes the pattern of light projected from the auxiliary lamp to lack uniformity and thus portions of the lighted area are only dimly lit. Additionally, during normal operation, the quartz lamp mounted on one side of the fixture blocks or refracts light from the HID lamp located at the center of the fixture. This causes the quartz lamp, during normal operation of the HID lamp, to form a shadow on the area being lit. It has also been found that emergency incandescent lamp sources are inherently glary and consistently mounted off of the centerline of the fixture, causing the luminaire to be aesthetically unappealing.

What is needed in the garage lighting industry is an auxiliary lamp system that provides emergency light without the problems found in the current systems.

SUMMARY OF THE INVENTION

An object of the present invention is to provide a luminaire having both a main lamp and an auxiliary lamp where the auxiliary lamp efficiently and reliably provides illumination when the main lamp fails to provide adequate illumination.

Another object of the present invention is to provide a luminaire having an auxiliary and a main lamp that provide uniform illumination without asymmetries to the area below.

A further object of the present invention is to provide a luminaire that has a main lamp and an auxiliary lamp where neither the main lamp or the auxiliary lamp cause shadowing.

It is yet another objective of the present invention to provide a luminaire having a main lamp and an auxiliary lamp so that the luminaire is aesthetically appealing.

These objects and others are accomplished according to the present invention by providing a luminaire for illuminating a wide area and having an auxiliary lamp that reliably emits adequate light efficiently and uniformly without causing shadowing of the light emitted from the main lamp and is aesthetically appealing.

The luminaire of the present invention includes a housing having a lower lamp mounting surface. This housing may be circular, square, or even irregular in shape. The lamp mounting surface may be reflective and may have prisms to increase the efficiency of the luminaire in lighting a desired area. A main light source, preferably a high intensity discharge (HID) lamp, is centrally mounted onto the lamp mounting surface and extends downward. This vertical arrangement provides for optimum illumination efficiency and life of the HID lamp. An auxiliary lamp is also mounted onto the lamp mounting surface. This auxiliary lamp may be a high output compact fluorescent circular lamp and located centrally about the lamp mounting surface surrounding a portion of the HID lamp. The auxiliary lamp surrounds, substantially at its center, a portion of the combination of the main lamp socket and main lamp and may have a light emitting portion closer to the lamp mounting surface of the housing than the light emitting portion of the main lamp. A lamp's light emitting portion is typically a filament or gaseous volume where light is generated within the lamp. Additionally, the luminaire optionally may have a main barrel shaped reflector surrounding a light emitting portion of the main lamp and mounted at a distance from the lamp mounting surface so that a large portion of the light being emitted from the auxiliary lamp is reflected to the area below by the barrel reflector. A downward portion of the light being emitted from the auxiliary lamp and much of the light reflected from the lamp mounting surface is redirected by the barrel reflector to provide an illumination pattern similar to the pattern created by the normal operation of the HID lamp. The luminaire may also have a lamp cover attached to the housing enclosing the auxiliary lamp, main lamp, lamp mounting surface, and optionally a barrel reflector. This lamp cover may have prisms forming a lens that spreads the light being emitted from the auxiliary lamp, main lamp, and light reflected from the lamp mounting surface and optional barrel reflector to desired areas to be illuminated.

DETAILED DESCRIPTION OF THE PREFERRED EMBODIMENTS

The present invention may best be understood by reference to the following description taken in conjunction with the accompanying figures. The figures illustrate specific embodiments in which the invention may be practiced and it is to be understood that other embodiments may be utilized as structural changes may be made without departing from the scope of the present invention.

Figure 1:
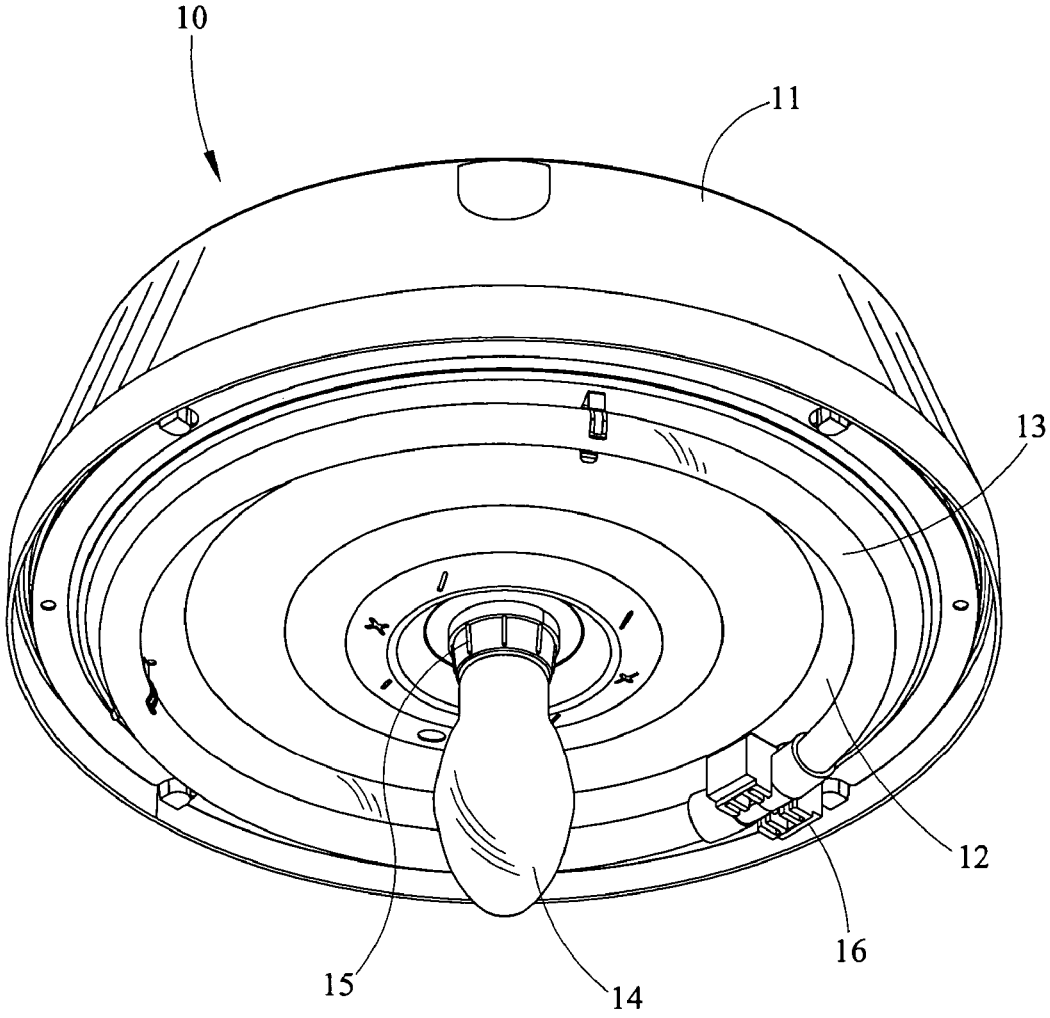
FIG. 1 is a perspective view of an embodiment of the luminaire of the present invention showing the high output compact fluorescent circular auxiliary lamp, main HID lamp, housing, lamp mounting surface, and their placement within the luminaire.

FIG. 1 is a perspective view of the garage luminaire 10 of the present invention showing the high output compact fluorescent circular auxiliary lamp 13, main HID lamp 14, housing 11, lamp mounting surface 12, and their placement within luminaire 10. In this embodiment of luminaire 10 the housing 11 is round or circular in shape. It is to be understood that housing 11 may be round, square, rectangular, oval or even irregular in shape and be within the scope of the present invention.

The housing 11 may hold the wiring, ballasts, auxiliary light switch, battery, and any other electrical equipment that may be associated with the main lamp 14 and auxiliary lamp 13. On the bottom of housing 11 is a lamp mounting surface 12. This lamp mounting surface 12 in this embodiment is round and covers most of the lower portion of housing 11 and may serve as the lower wall of housing 11. Lamp mounting surface 12 may have an anodized reflective surface, and as shown in the embodiment in the figures, may have ridges and troughs forming facets that reflect the light from the main lamp 14 and auxiliary lamp 13 to the desired areas.

Main lamp 14 is a HID lamp that is mounted into HID lamp socket 15 which is centrally located within lamp mounting surface 12. Lamp socket 15 is attached to lamp mounting surface 12 at a recessed center portion of lamp mounting surface 12 so that light emitted from lamp 14 is at a specific predetermined distance from lamp mounting surface 12.

Auxiliary lamp 13, a high output compact fluorescent circular lamp, is mounted annularly around lamp socket 15 and main lamp 14. Auxiliary lamp 13 is mounted to lamp mounting surface 12 with circular lamp socket 16 and lamp mounting brackets 401. Circular lamp socket 16 is attached near the outer edge of lamp mounting surface 12 at a non-recessed portion at a specific predetermined distance from lamp mounting surface 12 and provides an electrical connection to the lamp 13 electrodes and power supply, not shown.

Main lamp 14 extends downwardly from lamp mounting surface 12 while auxiliary lamp 13 is a circular lamp that has its light emitting portion closer to lamp mounting surface 12. This configuration allows main lamp 14 to project its light downwardly and radially with the aid of lamp mounting surface 12 and optionally barrel reflector 201 without having shadowing or refraction from auxiliary lamp 13 since main lamp 14 has its light emitting portion below auxiliary lamp 13. Additionally, both auxiliary lamp 13 and main lamp 14 have a light emitting portion centrally located with lamp mounting surface 12. This configuration provides symmetry to the luminaire 10 which improves the consistency in the direction and pattern of light being emitted from the luminaire 10 when the source of light is changed between HID lamp 14 and auxiliary lamp 13. The symmetry of lamp 14 and lamp 13 also improves the aesthetics of the luminaire 10.

Figure 2:
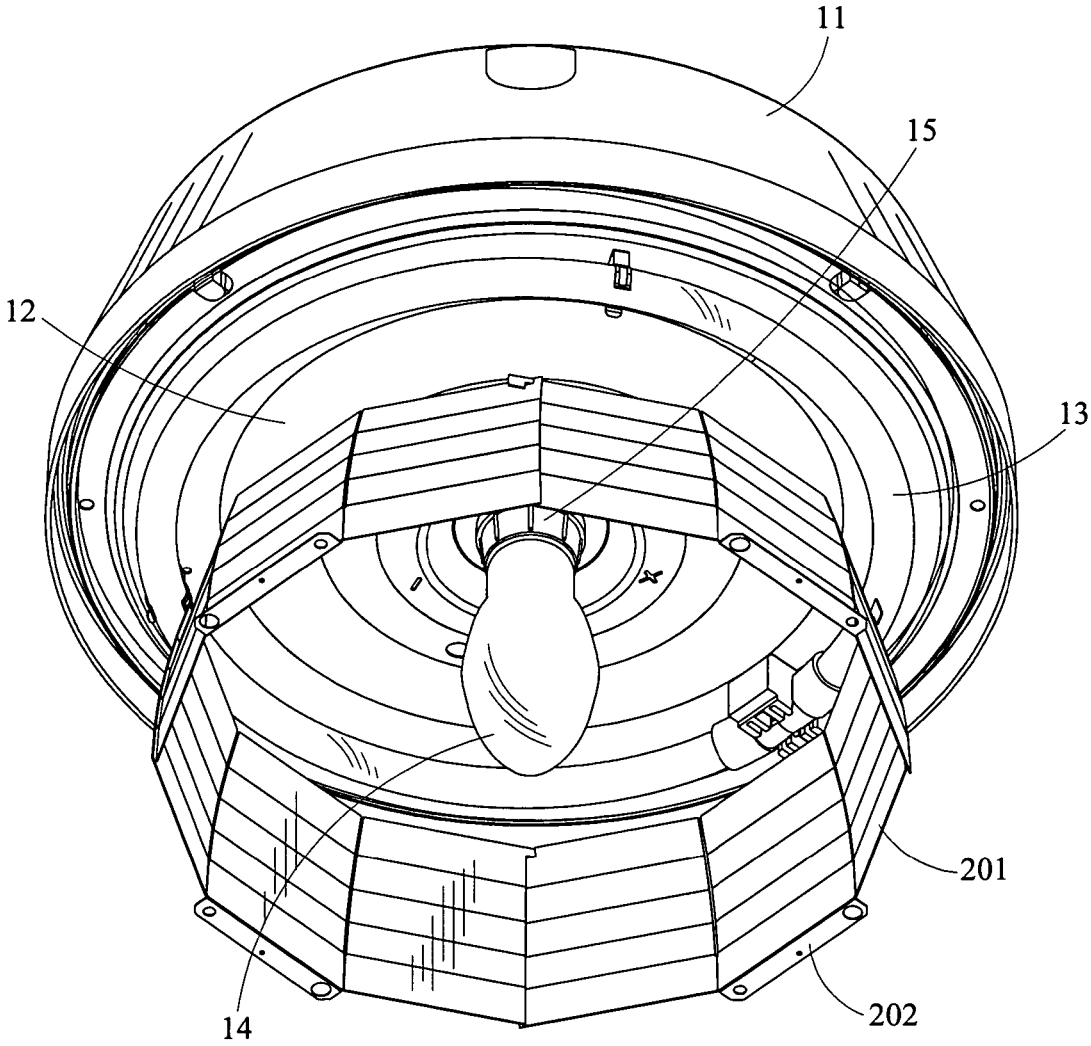
FIG. 2 is a lower perspective view of the luminaire in FIG. 1 showing an embodiment having a barrel reflector and its location within the luminaire.

FIG. 2 is a perspective view of the luminaire 10 of the present invention showing the placement of an optional barrel reflector 201 within luminaire 10. Barrel reflector 201 has an inner reflective surface and surrounds a portion of main lamp 14. Barrel reflector 201 reflects a portion of the radial light being emitted from main lamp 14 to the desired area below. In the embodiment of the barrel reflector 201 shown, the inner reflective surface has facets to disperse the light within the desired area to be lit. Barrel reflector 201 has mounting flanges 202 that hold barrel reflector 201 to a lamp cover 501. Barrel reflector 201 is typically frustospherical in shape and is mounted at a specific distance from lamp mounting surface 12 so that a large portion of light emitted from main lamp 14, auxiliary lamp 13, and reflected by lamp mounting surface 12 encounters the inner reflective surface of barrel reflector 201 and is reflected to the desired area below. Therefore, operation of either HID lamp 14 or auxiliary lamp 13 enables the luminaire 10 to produce a consistent and even light pattern on the area below.

Figure 3:
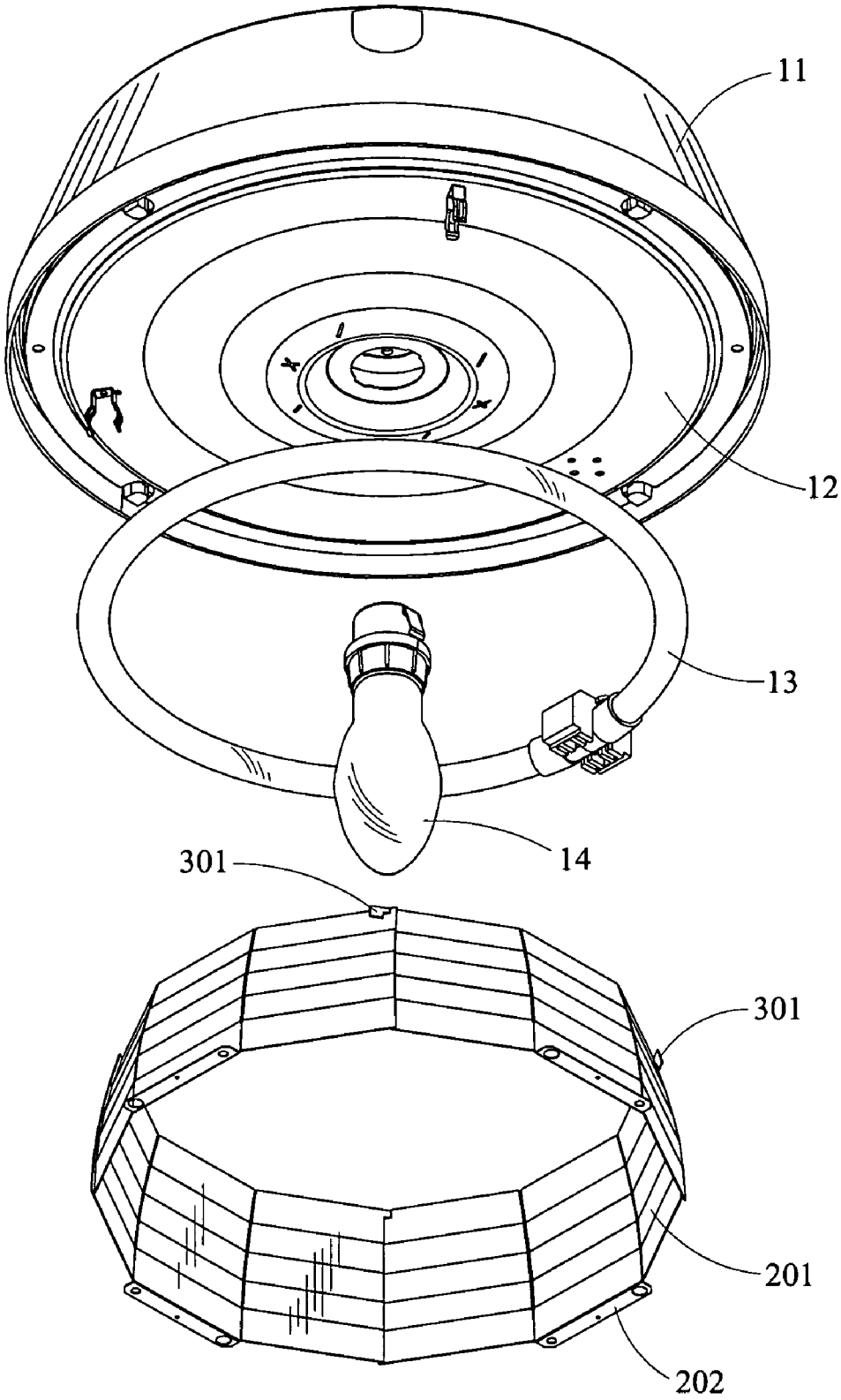
FIG. 3 is an exploded view of the luminaire in FIG. 2 showing the relationship of the components of the luminaire.

FIG. 3 is an exploded view of the luminaire 10 of the present invention showing the relationship of the components of the luminaire 10. Housing 11 and lamp mounting surface 12 are shown as being joined to form an enclosure. In this embodiment, lamp mounting surface 12 is a reflective bottom surface of housing 11. It should be understood that housing 11 may have a bottom surface to which a reflective lamp mounting surface 12 may be attached. This exploded view also shows auxiliary lamp 13 and main lamp 14 in a spatial relationship where it can be seen that the light being emitted from main lamp 14 is not impeded or refracted by auxiliary lamp 13 and hence does not create a shadow on the area to be lit. Additionally, barrel reflector retaining tabs 301 are shown here. In this embodiment, barrel reflector 201 is made up of a plurality of facets having slots and retaining tabs 301. Retaining tabs 301 aid in holding barrel reflector 201 together and providing strength to the frustospherical structure of barrel reflector 201.

Figure 4:
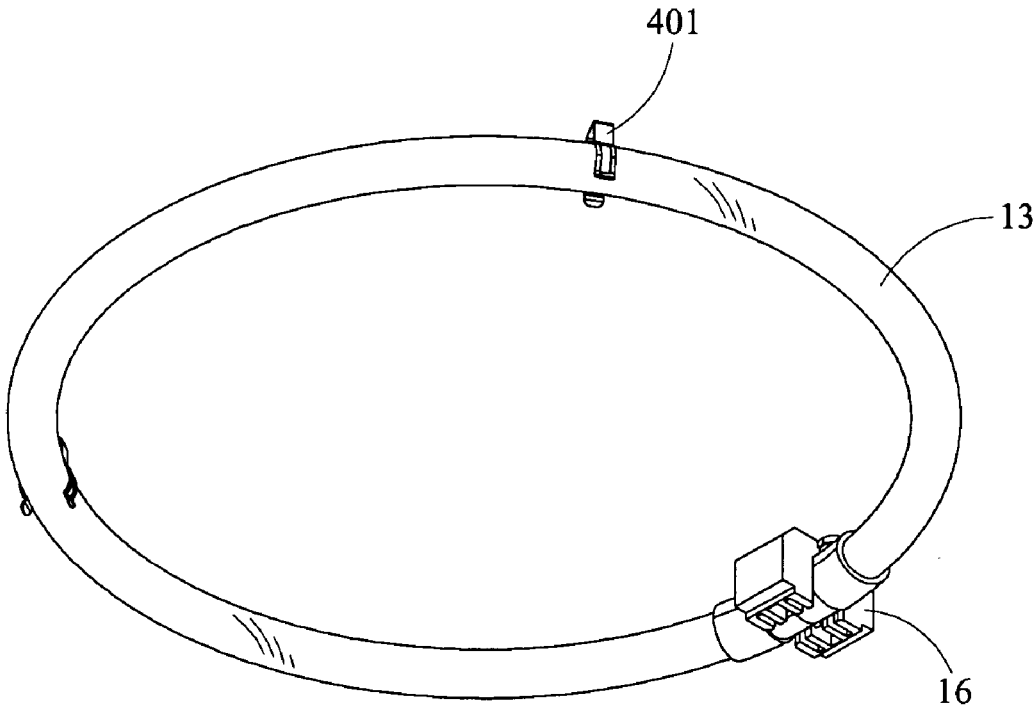
FIG. 4 is a view of the high output compact fluorescent circular auxiliary lamp, socket, and mounting brackets of the present invention.

FIG. 4 is a view of the high output compact fluorescent circular auxiliary lamp 13, socket 16, and mounting brackets 401. In this embodiment, mounting brackets 401 and auxiliary socket 16 are arranged at 120° intervals about the circular auxiliary lamp 13.

Figure 5:
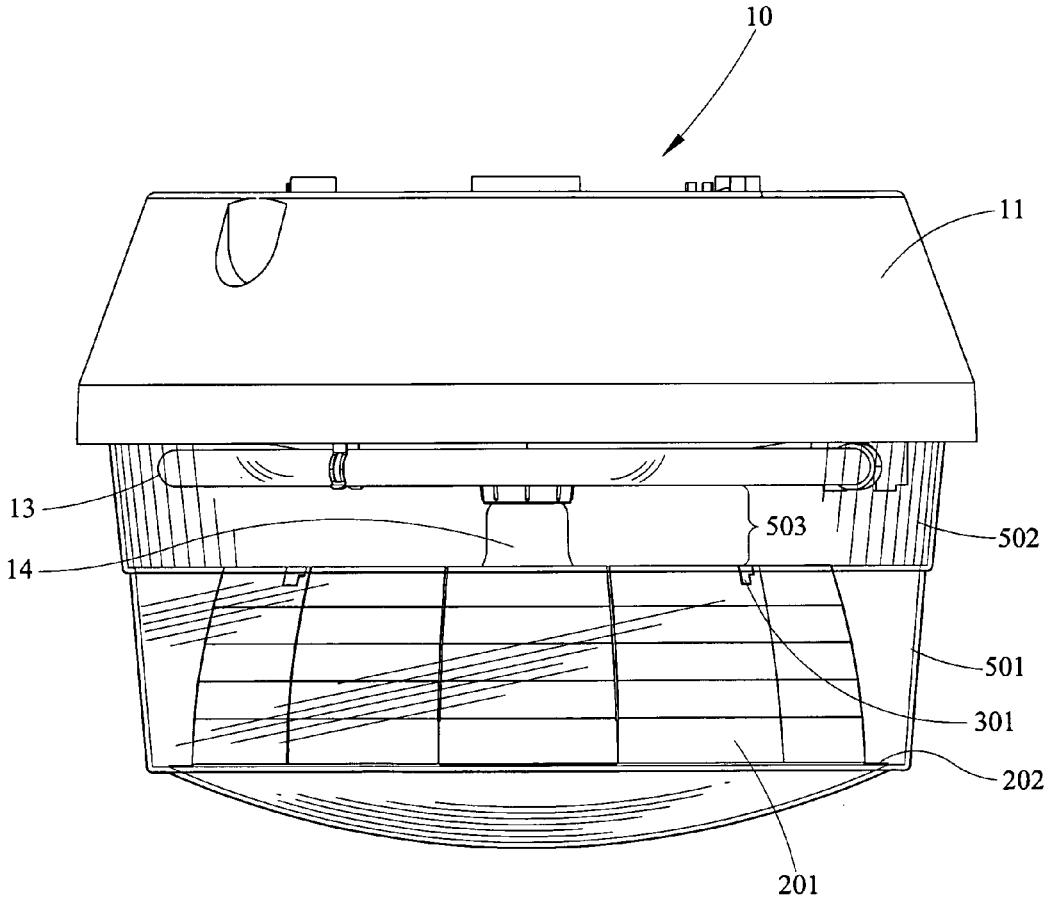
FIG. 5 is a side view of an embodiment of the garage light of the present invention having a lamp cover.
Figure 6:
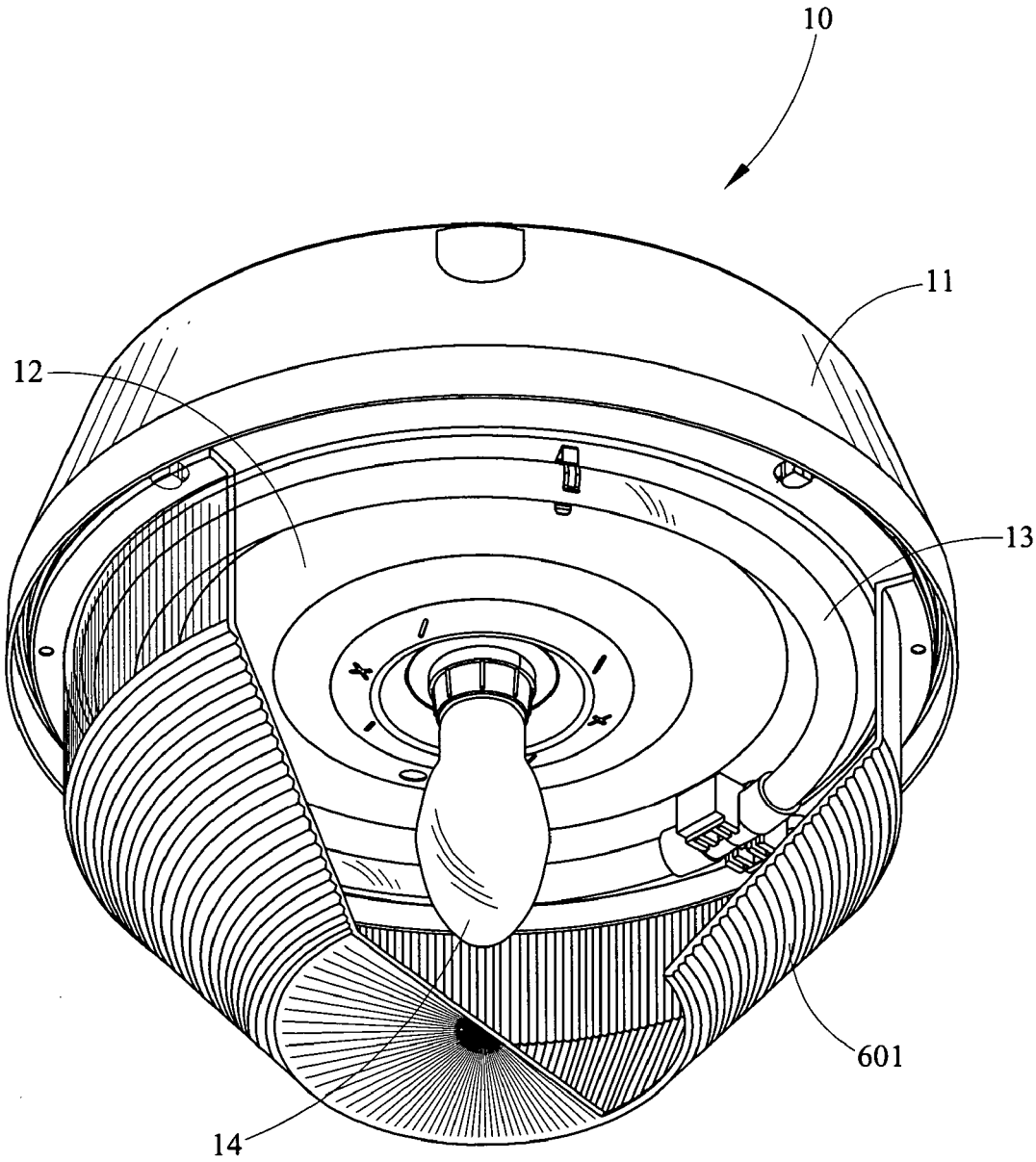
FIG. 6 is a perspective view of an alternative embodiment of the garage light of the present invention having an alternative embodiment of a lamp cover.

FIGS. 5 and 6 are views of the luminaire 10 of the present invention having alternative embodiments of a lamp cover (501 and 601). Specifically, FIG. 5 shows a side view of an embodiment of the garage light 10 of the present invention having a lamp cover 501. Lamp cover 501 has prisms 502 on an inner surface forming a lens located above barrel reflector 201. These prisms 502 are vertically extending ridges having sides at about 45° toward the optical center of the luminaire 10. In another embodiment, not shown, the ridge sides vary in angle toward the optical center of the luminaire so that light is focused toward alternative areas. These prisms 502 spread the light laterally causing the upper part of cover 501 to glow and reduce the glare that is associated with the garage luminaires in the prior art. Also shown in FIG. 5 is a gap 503 between barrel reflector 201 and auxiliary lamp 13. Gap 503 represents the distance between the light emitting portion of auxiliary lamp 13 and barrel reflector 201. In the embodiment not having barrel reflector 201, gap 503 represents a distance between the auxiliary lamp 13 and the light emitting portion of lamp 14. This embodiment of lamp cover 501 has a lower smooth surface that covers the bottom of barrel reflector 201. Also shown here is the location of flange 202 on lamp cover 501 which supports the barrel reflector 201 within luminaire 10. FIG. 6 shows perspective view of the garage light of the present invention having lamp cover 601. Lamp cover 601 may have prismatic surfaces on the exterior and/or interior side to direct light emitted from the lamps 13 and 14 and reflective surface 12. Incorporation of prismatic surfaces on lamp cover 601 typically causes the lamp cover to glow and directs the light to desired areas, thus eliminating the need for barrel reflector 201. These prismatic surfaces on lens 601 may be vertical, horizontal, rounded, square, or other configuration or shape as desired to refract the light being emitted from luminaire 10 to the desired locations. Additionally, the prismatic surfaces increase the aesthetics of luminaire 10.

Figure 7:
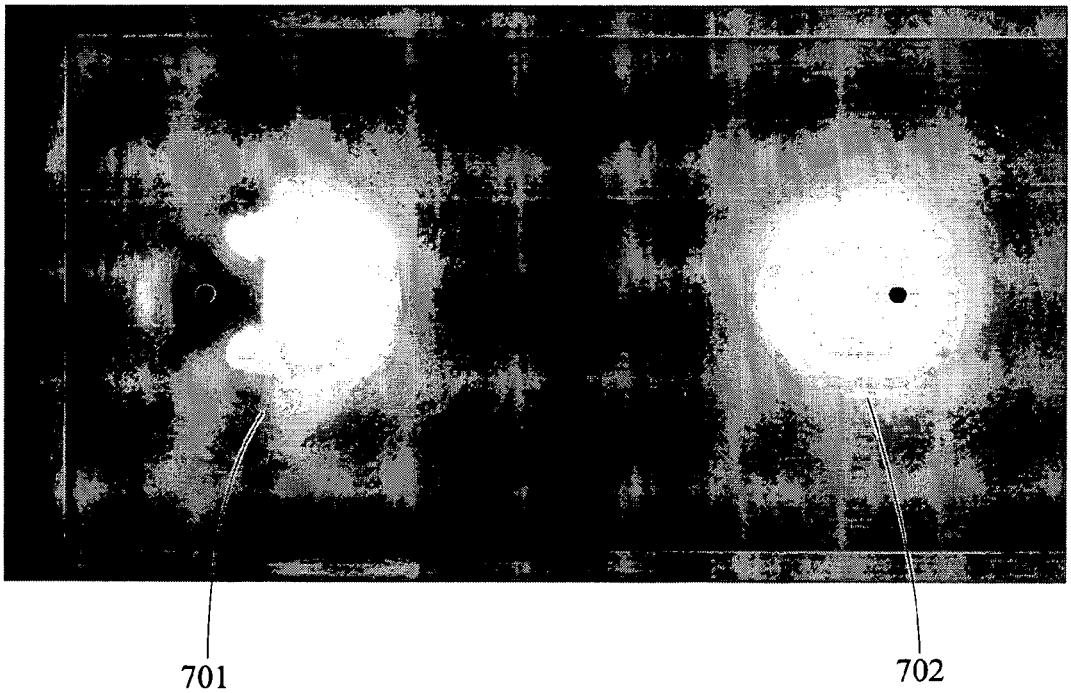
FIG. 7 is a photometric comparison of light levels achieved by the auxiliary lamps in the prior art and the light levels achieved by the auxiliary lamp of the present invention.

FIG. 7 is a photometric comparison of light levels achieved by the auxiliary lamps in the prior art 701 and the light levels achieved by the auxiliary lamp of the present invention 702. Photometric tests were performed to verify symmetric distribution of light from the auxiliary or emergency lamp 13. These lighting patterns were generated by having the luminaires ten feet from the floor area below. The dark circle in the prior art light distribution 701 and the light distribution found in the present invention 702 designate the location of the luminaire above the light pattern. The light pattern of the prior art 701 is asymmetrical since the quartz auxiliary lamps are not centrally located about the photometric center of the luminaire. Additionally, the main HID lamp and socket shadow a portion of light being emitted from the quartz auxiliary lamp of the prior art. Conversely, the light pattern 702 emitted from the auxiliary lamp 13 of the present invention is symmetrical and has no shadowing from HID lamp 14 or socket 15. The barrel reflector 201 and lamp mounting surface 12 reflect the light emitted from auxiliary lamp 13 evenly onto the surface below.

Figure 8:
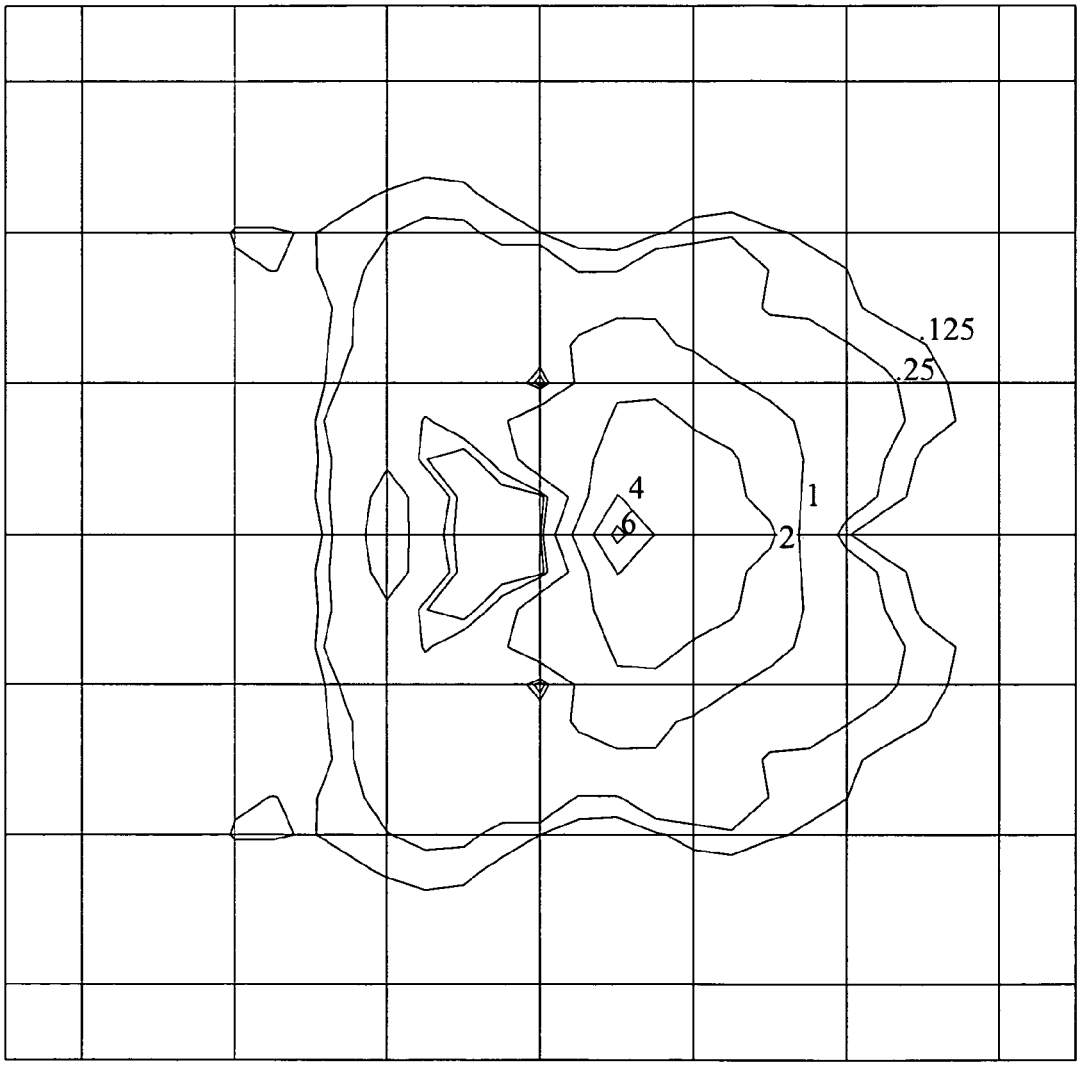
FIG. 8 is the photometric data of light levels achieved by the auxiliary lamps in the prior art.
Figure 9:
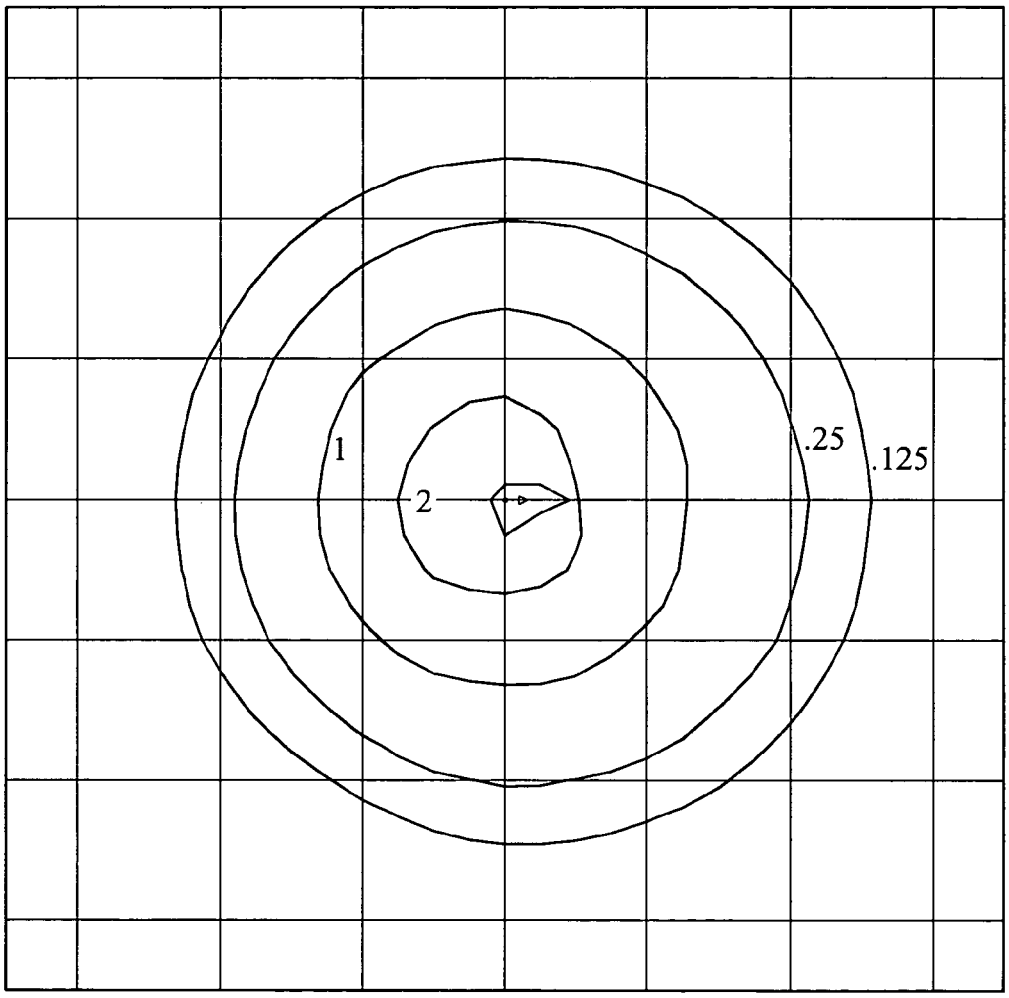
FIG. 9 is the photometric data of light levels achieved by the auxiliary lamp in the present invention.

FIGS. 8 and 9 are isofootcandle representations of the comparison of light levels achieved by the auxiliary lamps in the prior art FIG. 8 and the light levels achieved by the auxiliary lamp of the present invention as shown in FIG. 9. The grid lines in these figures represent ten square feet of floor area while the isofootcandle lines represent footcandles of illumination of the lighting patterns in FIG. 7. This numeric representation of the photometric data of light levels achieved by the quartz auxiliary lamps of the prior art in FIG. 8 and the photometric data of light levels achieved by the auxiliary lamp 13 of the present invention as shown in FIG. 9 clearly shows the symmetrical illumination of the present invention as compared to the asymmetrical illumination of the prior art. The illumination pattern of the prior art FIG. 8 has areas of intense illumination (>6 footcandles) and areas of almost no illumination (<0.125 footcandles) below the fixture. The illumination pattern of the present invention FIG. 9 is symmetrical and void of the bright and dark areas found in the prior art FIG. 8.

Figure 10:
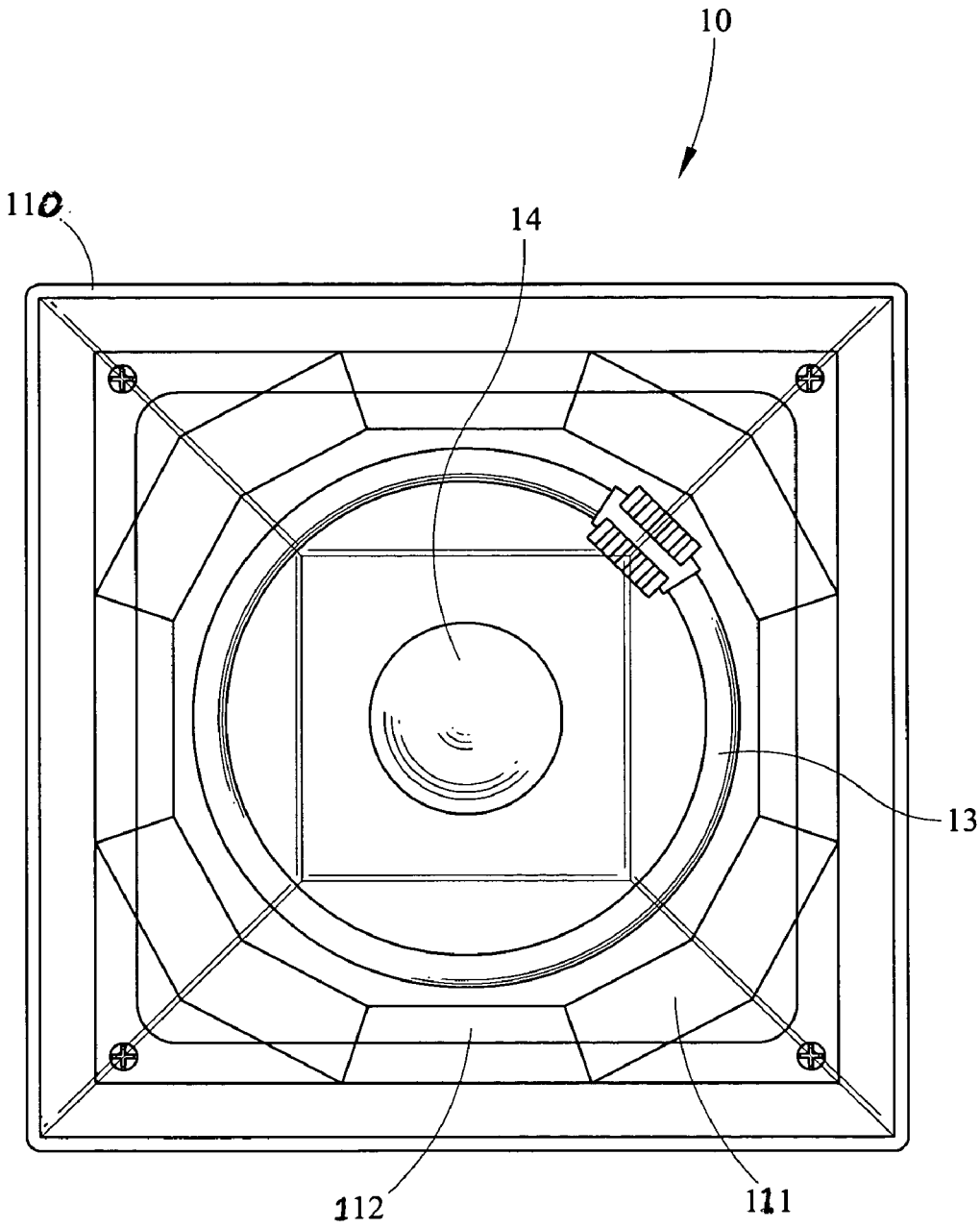
FIG. 10 is a perspective view of an embodiment of the luminaire of the present invention wherein the luminaire has a square shape.

FIG. 10 is a perspective view of an embodiment of the luminaire of FIG. 1 wherein the luminaire 10 has a square shaped housing 110. Additionally, shown here is a square lamp mounting surface 112 having kick reflectors 111 attached to the corners of lamp mounting surface 112 for redirecting light from the corner of the luminaire toward desired areas of illumination.

The Garage Light Luminaire With Circular Compact Fluorescent Emergency Lighting Optics of the present invention is an aesthetically appealing luminaire that has both a main lamp and an auxiliary lamp where the auxiliary lamp efficiently and reliably provides uniform illumination without asymmetries or shadows to the area below. The luminaire of the present invention meets the objectives previously set forth by having a high output compact fluorescent auxiliary lamp, HID main lamp, optional barrel reflector, and optional prismatic lenses within a lamp cover symmetrically located within the luminaire. The horizontal placement of the high output compact fluorescent auxiliary lamp, HID main lamp, optional barrel reflector and lens, in relation to the reflective lamp mounting surface provides for an efficient and consistent distribution of light to the area below.

We claim:

1. A garage light assembly comprising a housing having a uniform lamp mounting surface, a circular high output fluorescent lamp symmetrically mounted onto said lamp mounting surface, and a high intensity discharge lamp and socket combination mounted onto said lamp mounting surface wherein a portion of said lamp and socket combination extends substantially through a center portion of said circular high output fluorescent lamp, said lamp mounting surface, said circular high output fluorescent lamp, and said high intensity discharge lamp each having a configuration and orientation providing a substantially consistent illuminated pattern on a lighted surface when the source of light of said garage light assembly is switched from said high output fluorescent lamp to said high intensity discharge lamp.

2. The garage light assembly in claim 1 wherein said circular high output fluorescent lamp has a light emitting portion at a first distance from said lamp mounting surface and said high intensity discharge lamp has a light emitting portion at a second distance from said lamp mounting surface, said second distance being greater than said first distance.

3. The garage light assembly in claim 1 wherein said circular high output fluorescent lamp has a switching circuit for controlling the application of a voltage source to said circular high output fluorescent lamp upon an interruption of power to said high intensity discharge lamp.

4. The garage light assembly in claim 1 wherein said circular high output fluorescent lamp is electrically connected to an external emergency power supply system that supplies power to said high output fluorescent lamp upon power interruptions to said high intensity discharge lamp.

5. The garage light assembly in claim 1 wherein said lamp mounting surface is reflective.

6. The garage light assembly in claim 1 wherein said lamp mounting surface has a series of facets.

7. The garage light assembly in claim 1 wherein said lamp mounting surface has a barrel reflector with at least one reflective surface a distance there from and surrounds a central portion of said high intensity discharge lamp.

8. The garage light assembly in claim 7 wherein said barrel reflector has an upper end, said upper end of said barrel reflector being a greater distance from said lamp mounting surface than said circular high output fluorescent lamp.

9. The garage light assembly in claim 1 wherein said housing has a round shape.

10. A garage luminaire comprising a primary high intensity discharge lamp mounted symmetrically to a luminaire housing and an auxiliary lamp mounted symmetrically to said luminaire housing wherein said auxiliary lamp is nearer to said luminaire housing than said high intensity discharge lamp, said housing having a uniform surface proximate said lamps.

11. The garage luminaire in claim 10 wherein said luminaire has a barrel reflector mounted symmetrically to said luminaire housing substantially encircling said high intensity discharge lamp, said barrel reflector having an open top near said housing of a first radius and an open bottom of a second radius, said first radius being less than said second radius, and said open top of said barrel reflector being a greater distance from said housing than said auxiliary lamp.

12. A garage luminaire comprising:

a primary high intensity discharge lamp socket mounted to a luminaire housing, said luminaire housing having a continuous surface proximate said primary high intensity discharge lamp socket;

an auxiliary lamp socket mounted to said luminaire housing; and a means for providing uniform symmetrical light from said auxiliary lamp.

13. The garage luminaire of claim 12 wherein said means for providing uniform symmetrical light from said auxiliary lamp is comprised of having an auxiliary lamp centrally mounted within said garage luminaire.

14. The garage luminaire of claim 12 wherein said means for providing uniform symmetrical light from said auxiliary lamp is further comprised of having a barrel reflector mounted to said luminaire housing substantially encircling a light emitting portion of said high intensity discharge lamp and having an open top of a first radius and an open bottom of a second radius wherein said second radius is greater than said first radius.

15. An emergency combination garage light comprising:

a housing having a uniform lamp mounting surface;

a circular high output fluorescent lamp mounted to said lamp mounting surface substantially around a center of said lamp mounting surface; and a high intensity discharge lamp mounted substantially at said center of said lamp mounting surface.

16. The garage light of claim 15 further comprising a barrel reflector mounted substantially about said center of said lamp mounting surface and having an inner reflective surface surrounding a central portion of said high intensity discharge lamp.

17. The garage light of claim 16 wherein said barrel reflector is frustospherical in shape and has a top radius near said housing and a bottom radius, said top radius being smaller than said bottom radius.

18. A garage luminaire with emergency lighting comprising:

a housing having a uniform lamp mounting surface;

a round high output fluorescent emergency lamp mounted centrally to said lamp mounting surface wherein said emergency lamp is at a first distance from said lamp mounting surface; and a main high intensity discharge lamp mounted centrally to said lamp mounting surface and being a second distance from said lamp mounting surface, said second distance being greater than said first distance.

19. The garage luminaire of claim 18 wherein said lamp mounting surface is round in shape.

20. The garage luminarie of claim 18 further comprising a barrel reflector centrally attached to said lamp mounting surface wherein said barrel reflector surrounds a portion of said high intensity discharge lamp and has an upper end forming a gap between said emergency lamp and said barrel reflector.

21. A combination emergency and garage light, comprising:

a housing having a uniform mounting surface;

a circular secondary light source mounted adjacent said housing mounting surface;

a high intensity discharge lamp socket mounted substantially centrally to said housing mounting surface and said circular secondary light source.

22. A garage luminaire comprising a housing, secondary light source, and a high intensity discharge lamp mounted to a uniform surface of said housing so that said secondary light source is not shadowed by said high intensity discharge lamp and said secondary light source forms a symmetrical light pattern.

* * * * *